US010854134B2

(12) United States Patent
Kim

(10) Patent No.: US 10,854,134 B2
(45) Date of Patent: Dec. 1, 2020

(54) SOURCE SIGNAL DRIVING APPARATUS FOR DISPLAY DEVICE

(71) Applicant: SILICON WORKS CO., LTD., Daejeon-si (KR)

(72) Inventor: Young Gi Kim, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/225,498

(22) Filed: Dec. 19, 2018

(65) Prior Publication Data

US 2019/0197945 A1 Jun. 27, 2019

(51) Int. Cl.

| | |
|---|---|
| ***G09G 3/32*** | (2016.01) |
| ***G09G 3/36*** | (2006.01) |
| ***G09G 3/20*** | (2006.01) |

(52) U.S. Cl.

CPC ..... *G09G 3/32* (2013.01); *G09G 3/20* (2013.01); *G09G 3/36* (2013.01); *G09G 2310/027* (2013.01); *G09G 2310/0291* (2013.01); *G09G 2310/0297* (2013.01); *G09G 2310/08* (2013.01); *G09G 2330/026* (2013.01); *G09G 2330/027* (2013.01)

(58) Field of Classification Search

CPC .. G09G 3/32; G09G 3/20; G09G 3/36; G09G 2310/08; G09G 2310/0297; G09G 2330/027; G09G 2310/027; G09G 2310/0291; G09G 2330/026

See application file for complete search history.

(56) References Cited

U.S. PATENT DOCUMENTS

| | | | | |
|---|---|---|---|---|
| 5,977,944 | A * | 11/1999 | Kubota | G09G 3/3688 345/100 |
| 6,867,759 | B1 * | 3/2005 | Baek | G09G 3/3611 345/98 |
| 9,754,524 | B2 * | 9/2017 | Shirasaki | G09G 3/20 |
| 2001/0013850 | A1 * | 8/2001 | Sakaguchi | G09G 3/3611 345/87 |
| 2005/0156862 | A1 * | 7/2005 | Hirayama | G09G 3/3677 345/100 |
| 2006/0114217 | A1 * | 6/2006 | Kim | G09G 3/20 345/100 |
| 2010/0134474 | A1 * | 6/2010 | Watanabe | G09G 3/3648 345/213 |

(Continued)

FOREIGN PATENT DOCUMENTS

| | | |
|---|---|---|
| KR | 10-0909057 | 7/2009 |
| KR | 20100073739 A | 7/2010 |

(Continued)

OTHER PUBLICATIONS

English abstract of KR20100073739; retrieved from www.espacenet.com on Sep. 20, 2019.

(Continued)

*Primary Examiner* — Md Saiful A Siddiqui
(74) *Attorney, Agent, or Firm* — Polsinelli PC

(57) ABSTRACT

Disclosed is a source signal driving apparatus capable of implementing channels at high integration density. The source signal driving apparatus is configured to sequentially output source signals by sequentially delaying enable time points of enable signals provided to channel circuits.

16 Claims, 6 Drawing Sheets

(56) References Cited

U.S. PATENT DOCUMENTS

| | | | | |
|---|---|---|---|---|
| 2014/0198086 | A1* | 7/2014 | Cheng | G09G 3/20 345/209 |
| 2016/0063957 | A1* | 3/2016 | Shirasaki | G09G 3/20 345/213 |
| 2017/0213519 | A1* | 7/2017 | Chang | G09G 3/3688 |
| 2019/0189076 | A1* | 6/2019 | Yang | G09G 3/20 |

FOREIGN PATENT DOCUMENTS

| | | |
|---|---|---|
| KR | 10-1422081 | 7/2014 |
| KR | 10-2015-0067840 | 6/2015 |
| KR | 20170077546 A | 7/2017 |
| KR | 20170080349 A | 7/2017 |

OTHER PUBLICATIONS

English abstract of KR20170077546; retrieved from www.espacenet.com on Sep. 20, 2019.
English abstract of KR20170080349; retrieved from www.espacenet.com on Sep. 20, 2019.

* cited by examiner

SOURCE SIGNAL DRIVING APPARATUS FOR DISPLAY DEVICE

BACKGROUND

1. Technical Field

The present disclosure relates to a source signal driving apparatus for display device, and more particularly, to a source signal driving apparatus for a display device, which can implement channels at high integration density.

2. Related Art

A liquid crystal display (LCD) device using a liquid crystal element as a light source or a light emitting diode (LED) device using an LED as a light source includes a source driver for providing source signals for respective channels to a display panel.

The source driver may be manufactured as a semiconductor package, and mounted on the display panel through a chip-on-glass method. In general, a plurality of source drivers are configured for one display panel, and the number of source drivers is decided according to the size and resolution of the display panel.

Recently, the development of semiconductor process technology has significantly improved the integration density of semiconductor chips. As a result, source drivers can be configured to include a larger number of channels in the same area.

Thus, when the source drivers including a larger number of channels is applied to the same display panel, the number of source drivers configured for the display panel can be reduced.

However, the increase in number of channels in the source driver increases the possibility that a high in-rush current will occur as source signals are outputted at the same time. In particular, when a channel-on operation of a source driver in connection with a power-on sequence or a channel-off operation of a source driver in connection with a power-off sequence is performed in a display device, such a large in-rush current is highly likely to occur.

The in-rush current may drop power applied to a source driver, cause a ground voltage $V_{SS}$ to bounce, and generate power noise to cause a malfunction of the source driver. Furthermore, stress caused by the in-rush current may cause migration of a power line inside or outside the source driver, an external element and a bounding region.

SUMMARY

Various embodiments are directed to a source signal driving apparatus for a display device, which can suppress an occurrence of in-rush current by an output of a source signal, even when having an increased integration density and an increased number of channels.

Also, various embodiments are directed to a source signal driving apparatus for a display device, which can suppress an occurrence of in-rush current by an output of a source signal, when a channel-on operation of a source driver in connection with a power-on sequence or a channel-off operation of a source driver in connection with a power-off sequence is performed.

In an embodiment, a source signal driving apparatus for a display device may include: a plurality of channel circuits formed in one driver implemented as a chip, divided into a plurality of groups, and each configured to output source signals; a controller configured to provide one or more enable signals; and transfer buffers each configured to transfer the one or more enable signals between a pair of groups, delay enable time points of the one or more enable signals by a preset time, and transfer the one or more enable signals, wherein the one or more enable signals are sequentially transferred to the plurality of groups while the enable time points are gradually delayed by the transfer buffers, and the plurality of channel circuits sequentially output the source signals at different enable time points by the one or more enable signals for the respective groups.

In an embodiment, a source signal driving apparatus for a display device may include: a plurality of channel circuits formed in one driver implemented as a chip, divided into a plurality of groups, and each configured to output source signals; and a controller configured to provide the groups with an equal number of one or more enable signals having different enable time points for the respective groups, wherein the plurality of channel circuits sequentially output the source signals at different enable time points by the one or more enable signals for the respective groups.

In an embodiment, a source signal driving apparatus for a display may include: a plurality of channel circuits formed in one driver implemented as a chip, divided into a plurality of groups, and each configured to output source signals; a controller configured to provide enable data which is enabled during an enable period for outputting the source signals and a shift clock which has a plurality of cycles during the enable period; and signal providing units corresponding to the respective groups, and each configured to provide one or more enable signals to the corresponding group, wherein the enable data and the shift clock are sequentially transferred to the enable signal providing units, the enable signal providing units generate the one or more enable signals having enable time points which are sequentially delayed in synchronization with the shift clock according to the transfer order of the enable data and the shift clock, and the plurality of channel circuits sequentially output the source signals in response to different enable time points by the one or more enable signals for the respective groups.

DETAILED DESCRIPTION

Figure 1:
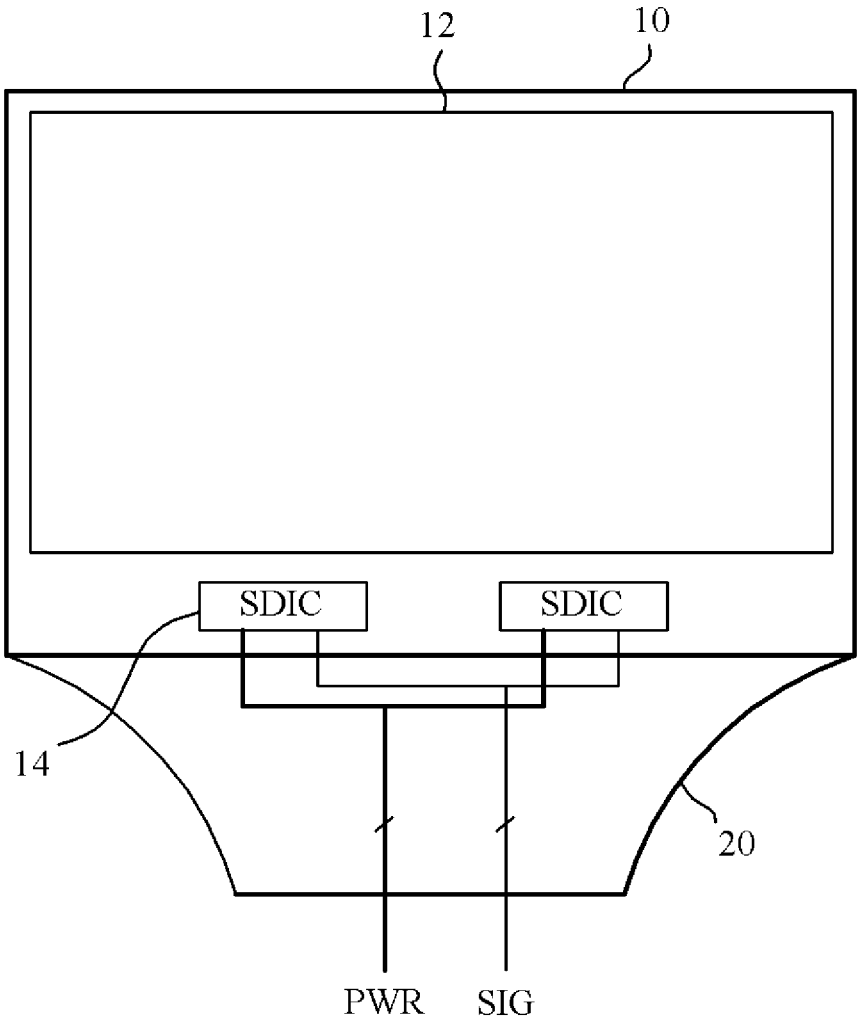
FIG. 1 is an arrangement diagram for describing a display device in accordance with an embodiment of the present invention.

Hereafter, embodiments of the present invention will be described in detail with reference to the accompanying drawings. The terms used in this specification and claims are not limited to typical dictionary definitions, but should be interpreted as meanings and concepts which coincide with the technical idea of the present invention.

Embodiments described in this specification and configurations illustrated in the drawings are preferred embodiments of the present invention, and do not represent the entire technical idea of the present invention. Thus, various equivalents and modifications capable of replacing the embodiments and configurations may be provided at the time that the present application is filed.

A display device to which a source signal driving apparatus in accordance with an embodiment of the present invention may be understood as a liquid crystal display (LCD) or a flat panel display device including pixels configured as light emitting diodes (LEDs).

The display device has a configuration in which a flexible printed circuit board (FPCB) 20 is coupled to a display panel 10 as illustrated in FIG. 1.

The display panel 10 is manufactured using glass as a substrate, and has pixels formed in a preset display region 12. The display region 12 serves to display an image by driving the pixels.

A source driver SDIC is bonded on the glass at one side of the display region 12 of the display panel 10 through a chip-on-glass method.

The source driver SDIC includes input pads and output pads. The output pads form channels for outputting source signals, and are electrically coupled to output lines formed on the glass through bonding. The output lines may be understood as electrical wirings to which the pixels of the display region 12 of the display panel 10 are coupled. The input pads form channels for inputting power PWR and input signals SIC containing display data, which are provided from outside, and are electrically coupled to power lines and input lines formed on the glass through bonding.

The FPCB 20 is connected to one side of the display panel 10. The display panel 10 and the FPCB 20 may be connected through a conductive adhesive or conductive adhesive film. Through the above-described connection, the power lines and the signal lines of the FPCB 20 may be electrically coupled to the input lines of the display panel 10. The power lines may be understood as lines for transferring various voltages corresponding to the power PWR. Through the power lines, an analog supply voltage AVDD, a digital supply voltage DVDD and the ground voltage VSS, which will be described below, may be provided to the display panel 10. The signal lines may be understood as lines for transferring input signals SIG such as display data.

FIG. 1 illustrates that two source drivers SDIC are configured for the display panel 10.

In the present invention, a source driver which has high integration density and thus includes a larger number of channels than in the related art is used as the source driver SDIC. Therefore, the display panel 10 may be configured to include a smaller number of source drivers SDIC than in the related art. For example, FIG. 1 illustrates that two source drivers SDIC are configured for the display panel 10. When a conventional source driver having low integration density is used, three or more source drivers may be configured in the display panel 10.

In the present invention, the source driver SDIC may be understood as the source signal driving apparatus or a part of the source signal driving apparatus.

Figure 2:
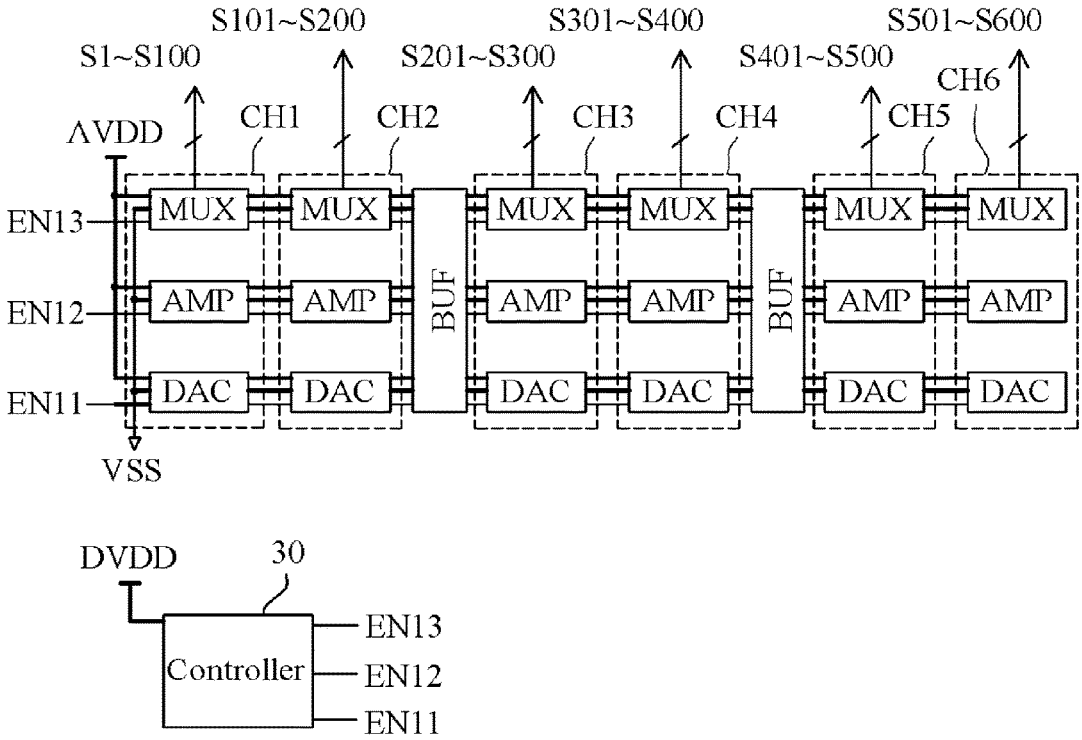
FIG. 2 is a circuit diagram illustrating a source signal driving apparatus for a display device in accordance with an embodiment of the present invention.

More specifically, when the controller 30 which will be described below with reference to FIG. 2 is embedded in the source driver SDIC, the source driver SDIC may be understood as the source signal driving apparatus. On the other hand, when the controller 30 is configured outside the source driver SDIC, the source driver SDIC may be understood as a part of the source signal driving apparatus excluding the controller 30. The controller may be understood as a timing controller which is generally applied to a display device.

The source signal driving apparatus in accordance with the embodiment of the present invention may be embodied as illustrated in FIG. 2. The source signal driving apparatus in accordance with the embodiment of FIG. 2 divides output time points of source signals into groups through transfer buffers that delay an enable time point of an enable signal, thereby suppressing an occurrence of in-rush current.

Referring to FIG. 2, the source signal driving apparatus in accordance with the embodiment of the present invention includes a plurality of channel circuits CH1 to CH6, transfer buffers BUF and a controller 30.

Each of the channel circuits CH1 to CH6 may be configured to use the same power source, and include one or more parts for outputting source signals. The channel circuits CH1 to CH6 are configured to output previously assigned numbers of source signals S1 to S100, S101 to S200, S201 to S300, S301 to S400, S401 to S500 and S501 to S600, respectively.

In FIG. 2, each of the channel circuits CH1 to CH6 includes a digital-analog converter DAC, an output buffer AMP and a multiplexer MUX. Unlike the above-described configuration, each of the channel circuits CH1 to CH6 may be modified to include one or more of the digital-analog converter DAC, the output buffer AMP and the multiplexer MUX.

The digital-analog converter DAC, the output buffer AMP and the multiplexer MUX, which are included in each of the channel circuits CH1 to CH6, operate using the same analog supply voltage AVDD and the ground voltage VSS in common. The analog supply voltage AVDD may be understood as a DC voltage having a higher level than the digital supply voltage DVDD used in the controller 30.

In each of the channel circuits CH1 to CH6, the digital-analog converter DAC selects and outputs a gamma voltage corresponding to digital display data, the output buffer AMP drives an output voltage of the digital-analog converter DAC and outputs the output voltage as a source signal, and the multiplexer MUX selectively transfers the source signal of the output buffer AMP to the corresponding pixel of the display region 12 of the display panel 10. The digital-analog converter DAC, the output buffer AMP and the multiplexer MUX may receive enable signals EN11 to EN13, respectively, and start the corresponding operations in synchronization with enable time points of the enable signals.

The plurality of channel circuits CH1 to CH6 are formed in one driver (source driver) implemented as a chip, and divided into a plurality of groups. For example, the channel circuits CH1 and CH2, the channel circuits CH3 and CH4 and the channel circuits CH5 and CH6 may be divided and defined as the respective groups.

The source signal driving apparatus may include a clock data recovery unit (not illustrated) which receives display data and recovers data and a clock signal, a latch (not illustrated) which performs digital processing using the recovered clock and data, a level shifter (not illustrated) and the like, but the detailed descriptions of the units will be omitted herein, for convenience of description.

The controller 30 provides one or more enable signals to the plurality of channel circuits CH1 to CH6. In FIG. 2, the controller 30 is configured to provide the enable signals EN11 to EN13. The enable signal EN11 is provided to the digital-analog converter DAC, the enable signal EN12 is provided to the output buffer AMP, and the enable signal EN13 is provided to the multiplexer MUX.

The transfer buffer BUF is configured to transfer the enable signals between a pair of groups included in the plurality of channel circuits CH1 to CH6. At this time, the transfer buffer BUF may perform an operation of amplifying a transferred signal. More specifically, the transfer buffer BUF is configured between the group of the channel circuits CH1 and CH2 and the group of the channel circuits CH3 and CH4 and between the group of the channel circuits CH3 and CH4 and the group of the channel circuits CH5 and CH6. The transfer buffer BUF receives the enable signals EN11 to EN13, delays the enable time points of the enable signals EN11 to EN13 by a preset time, and outputs the enable signals EN11 to EN13 of which the enable time points are delayed. For this operation, the transfer buffer BUFF may include flip-flops or delay elements.

Typically, the source driver has output terminals which forms a channel and are arranged in a line or a plurality of lines along one side of the chip. According to the configuration of the output terminals, the channel circuits CH1 to CH6 may also be arranged along one side of the chip of the source driver so as to correspond to the respective output terminals within the chip. The transfer buffers BUF may be placed among the channel circuits CH1 to CH6, and thus configured to receive and output the enable signals EN11 to EN13. More specifically, the transfer buffers BUF may be placed between the channel circuits CH2 and CH3 (first position) and between the channel circuits CH4 and CH5 (second position), respectively. For example, the transfer buffer BUF placed at the first position receives the enable signals EN11 to EN13 via the channel circuits CH1 and CH2, and provides the group of the channel circuits CH3 and CH4 with the enable signals EN11 to EN13 of which the enable time points are delayed therein.

In each of the groups, the enable signals EN11 to EN13 may be inputted in parallel to the channel circuits included in the group or sequentially inputted to the channel circuits included in the group.

Thus, in the embodiment of FIG. 2, the enable signals EN11 to EN13 are outputted from the controller 30 and inputted to the digital-analog converter DAC, the output buffer AMP and the multiplexer MUX of the channel circuit CH1 of the first group, respectively. Then, the enable signals EN11 to EN13 are sequentially transferred to the channel circuit CH2, the transfer buffer BUF, the channel circuits CH3 and CH4, the transfer circuit BUF and the channel circuits CH5 and CH6.

During the transfer process, the enable time points of the enable signals EN11 to EN13 are gradually delayed by the transfer buffers BUF. That is, the channel circuits of the group receiving the enable signals from the transfer buffer BUF output the source signals at a later enable time point than the channel circuits of the group having received the enable signals before the transfer buffer BUF.

Therefore, the plurality of channel circuits CH1 to CH6 sequentially output the source signals at different enable time points according to the enable signals EN11 to EN13 for the respective groups.

The operation in which the plurality of channel circuits CH1 to CH6 output the source signals at different enable time points in accordance with the embodiment of the present invention may included in a channel-on operation by turn-on of the power for the display device or a channel-off operation by turn-off of the power for the display device.

A power-on sequence based on turn-on of the power for the display device will be described with reference to FIG. 3.

When the power of the display device is turned on, a channel-on operation of the source driver is performed after initialization is performed, and the source driver normally operates after the channel-on operation. The initialization corresponds to a period PA of FIG. 3, the channel-on operation of the source driver corresponds to a period PB of FIG. 3, and the normal operation of the source driver corresponds to a period PC of FIG. 3.

When the power is turned on, the display device performs the power-on sequence in which stabilization of the digital supply voltage DVDD, stabilization of the analog supply voltage AVDD, register setting, resetting of the timing controller and turn-on of the source driver are sequentially performed.

After the last step of the power-on sequence, that is, the turn-on of the source driver, the channel-on operation is performed.

The channel circuits CH1 to CH6 in accordance with the embodiment of the present invention output the source signals at different enable time points for the respective groups through the channel-on operation. That is, the group of the channel circuits CH1 and CH2 outputs the source signals S1 to S200 in synchronization with the enable signals EN11 to EN13 at time T11, the group of the channel circuits CH3 and CH4 outputs the source signals S201 to S400 in synchronization with the enable signals EN11 to EN13 of which the enable time points are delayed by the buffer BUF, at time T12, and the group of the channel circuits CH5 and CH6 outputs the source signals S401 to S600 in synchronization with the enable signals EN11 to EN13 of which the enable time points are further delayed by the buffer BUF, at time T13.

As the output time points of the source signals are distributed in response to the power-on sequence, an occurrence of in-rush current can be suppressed when the source signals are outputted.

Even during the power-off sequence of the display device based on turn-off of the power, the source signal driving apparatus in accordance with the embodiment of the present invention can suppress an occurrence of in-rush current.

The power-off sequence based on turn-off of the power will be described with reference to FIG. 4.

When the power of the display device is turned off, the source driver which is normally operating performs a channel-off operation. Then, the source driver, the timing controller, the register and the power source are powered down. At this time, the normal operation of the source driver corresponds to a period FA of FIG. 4, the channel-off operation of the source driver corresponds to a period FB of FIG. 4, and the power-down operations of the source driver, the timing controller, the register and the power source are performed in a period FC of FIG. 4.

When the power of the display device is turned off, the source driver first performs the channel-off operation in the normal operation state.

After the channel-off operation of the source driver, the display device performs the power-off sequence to sequentially turn off the source driver and the timing controller.

In the present embodiment, the channel-off operation is performed at the first step of the power-off sequence, that is, before the turn-off of the source driver. The channel circuits CH1 to CH6 in accordance with the embodiment of the present invention stops outputting the source signals at different enable time points for the respective groups through the channel-off operation. That is, the group of the channel circuits CH1 and CH2 stops outputting the source signals S1 to S200 in synchronization with the enable signals EN11 to EN13 at time T14, the group of the channel circuits CH3 and CH4 stops outputting the source signals S201 to S400 in synchronization with the enable signals EN11 to EN13 of which the enable time points are delayed by the buffer BUF, at time T15, and the group of the channel circuits CH5 and CH6 stops outputting the source signals S401 to S600 in synchronization with the enable signals EN11 to EN13 of which the enable time points are further delayed by the buffer BUF, at time T16.

As the time points that the outputs of the source signals are stopped are distributed in response to the power-off sequence, it is possible to suppress an occurrence of in-rush current by changes of the source signals.

As described above, the source signal driving apparatus in accordance with the embodiment of the present invention can suppress an occurrence of in-rush current by the source signals.

The source signal driving apparatus in accordance with the embodiment of the present invention can reduce malfunctions which may occur due to an in-rush current, and prevent various migrations. As a result, the source signal driving apparatus can simplify the manufacturing process while securing the price competitiveness of the display device, and provide convenience in design while lowering a failure rate.

Figure 5:
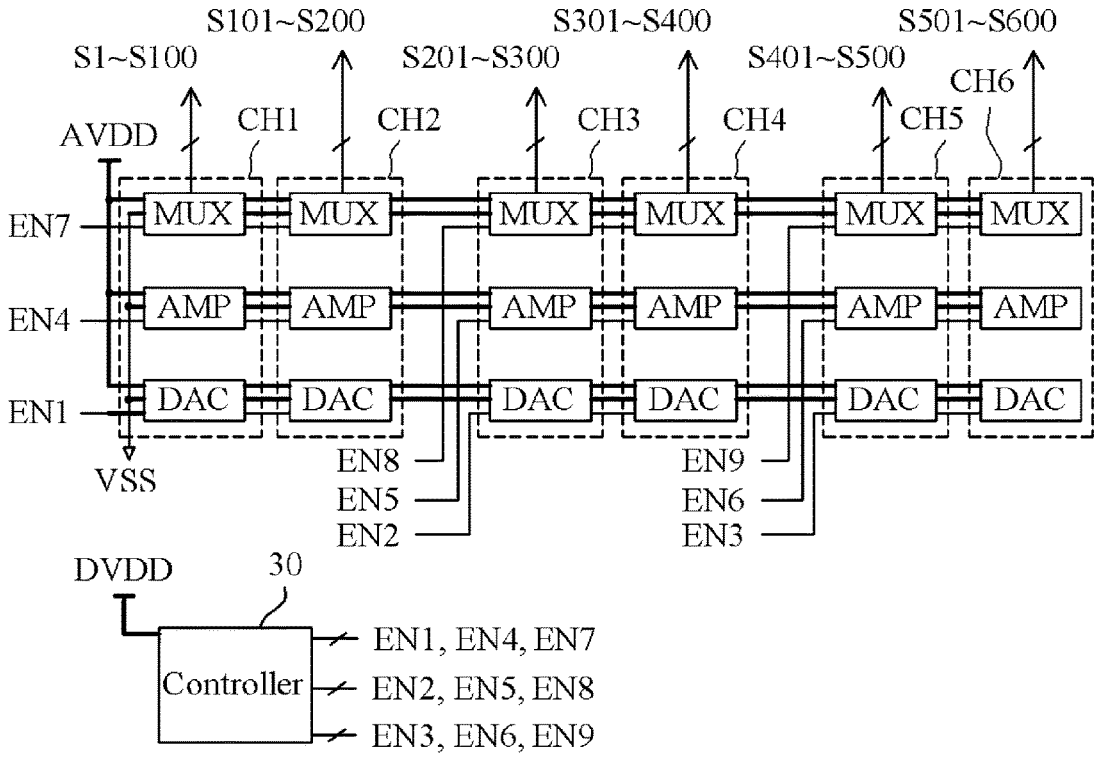
FIG. 5 is a circuit diagram illustrating a source signal driving apparatus for a display device in accordance with another embodiment of the present invention.

The source signal driving apparatus in accordance with the embodiment of the present invention can be embodied as illustrated in FIG. 5, and distribute the output time points of the source signals on a group basis, thereby suppressing an occurrence of in-rush current.

Referring to FIG. 5, the source signal driving apparatus in accordance with the embodiment of the present invention includes a plurality of channel circuits CH1 to CH6 and a controller 30. In the configuration of FIG. 5, the plurality of channel circuits CH1 to CH6 are configured in the same manner as those of FIG. 1. Thus, the detailed descriptions of the configurations and operations thereof will be omitted herein.

The controller 30 is configured to provide an equal number of one or more enable signals having different enable time points to the respective groups of the plurality of channel circuits CH1 to CH6.

In the embodiment of FIG. 5, the controller 30 provides enable signals EN1, EN4 and EN7 to the digital-analog converters DAC, the output buffers AMP and the multiplexers MUX in the group of the channel circuits CH1 and CH2, provides enable signals EN2, EN5 and EN8 to the digital-analog converters DAC, the output buffers AMP and the multiplexers MUX in the group of the channel circuits CH3 and CH4, and provides enable signals EN3, EN6 and EN9 to the digital-analog converters DAC, the output buffers AMP and the multiplexers MUX in the group of the channel circuits CH5 and CH6.

The controller 30 may be configured to provide the enable signals having the same enable time point or different enable time points to the same group. When the enable time points of the enable signals are different, the controller 30 may be configured to provide the enable signal having the earliest enable time point to the digital-analog converter DAC, and provide the enable signal having the latest enable time point to the multiplexer MUX.

FIG. 5 exemplifies that the controller 30 provides the enable signals EN1, EN4 and EN7 having the earliest enable time point to the group of the channel circuits CH1 and CH2, and provides the enable signals EN3, EN6 and EN9 having the latest enable time points to the group of the channel circuits CH5 and CH6.

Therefore, the channel circuits CH1 to CH6 may be sequentially output the source signals in synchronization with different enable time points for the respective groups.

As described above, the controller 30 provides the enable signals EN1, EN4, EN7/EN2, EN5, EN8/EN3, EN6, EN9 for the respective groups to have differences in the enable time points. For this operation, the controller 30 may generate the enable signals EN1, EN4, EN7/EN2, EN5, EN8/EN3, EN6, EN9 such that the respective groups have differences in enable time points on a basis of the cycle of an internal clock or the delay of an internal delay block.

The source signal driving apparatus in accordance with the embodiment of FIG. 5 may also perform the operation in which the plurality of channel circuits CH1 to CH6 output the source signals at different enable time points during a channel-on operation after turn-on of the driver, included in the power-on sequence of the display device, and a channel-off operation before turn-off of the driver, included in the power-off sequence of the display device, as described with reference to FIG. 2.

Figure 3:
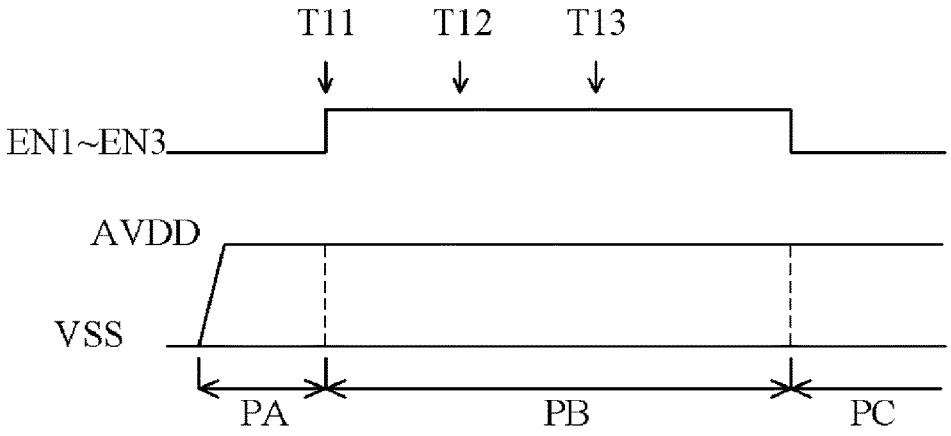
FIG. 3 is a waveform diagram for describing an operation of the source signal driving apparatus in accordance with the embodiment of FIG. 2 in response to a power-on sequence.
Figure 4:
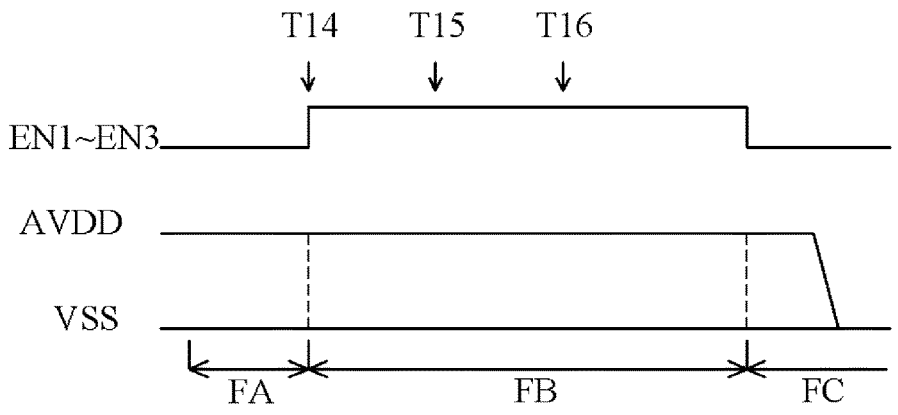
FIG. 4 is a waveform diagram for describing an operation of the source signal driving apparatus in accordance with the embodiment of FIG. 2 in response to a power-off sequence.

Since the operation has the same effect as the embodiment of FIGS. 2 to 4, the duplicated descriptions thereof will be omitted herein.

Figure 6:
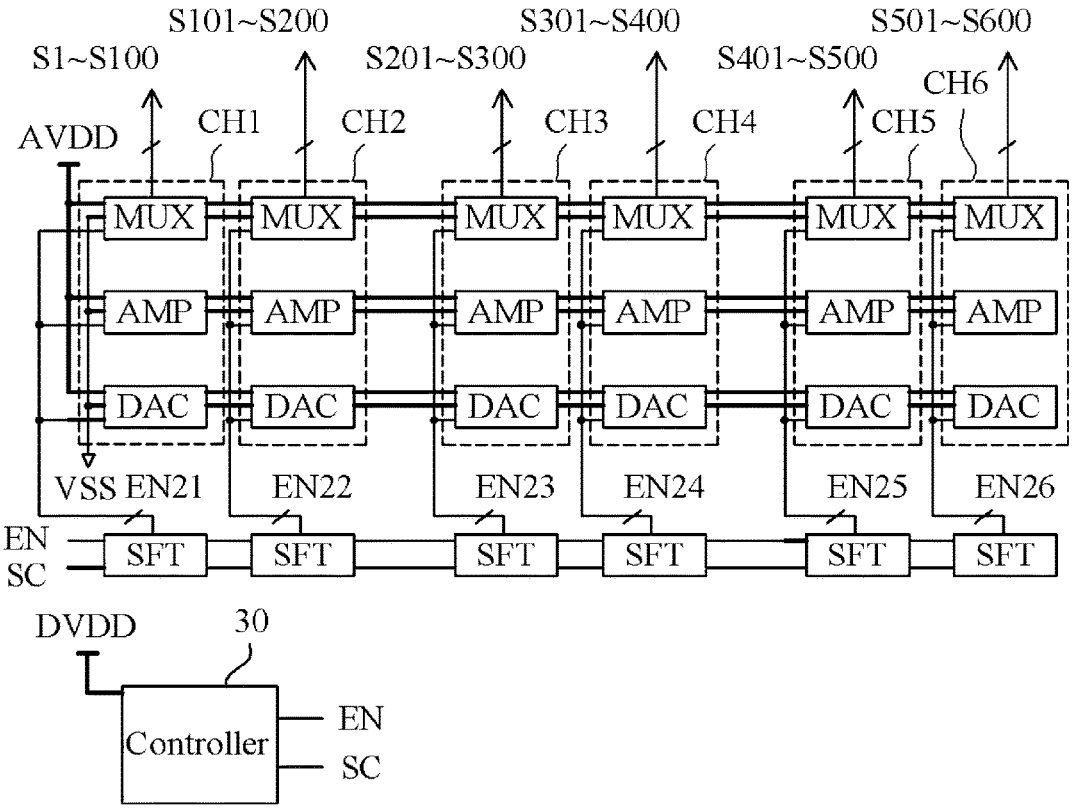
FIG. 6 is a circuit diagram illustrating a source signal driving apparatus for a display device in accordance with still another embodiment of the present invention.

The source signal driving apparatus in accordance with the embodiment of the present invention can be embodied as illustrated in FIG. 6, and distribute the output time points of the source signals on a group basis, thereby suppressing an occurrence of in-rush current.

Referring to FIG. 6, the source signal driving apparatus in accordance with the embodiment of the present invention includes a plurality of channel circuits CH1 to CH6, enable signal providing units and a controller 30. In the configuration of FIG. 6, the plurality of channel circuits CH1 to CH6 are configured in the same manner as those of FIG. 5. Thus, the detailed descriptions of the configurations and operations thereof will be omitted herein.

In the above-described configuration, the controller 30 is configured to provide enable data EN and a shift clock SC. The enable data EN is enabled during an enable period for outputting source signals, and the shift clock SC has a plurality of cycles during the enable period.

The enable signal providing units correspond to the respective groups of the plurality of channel circuits CH1 to CH6, and are configured to sequentially transfer the enable data EN and the shift clock SC and provide one or more enable signals to the corresponding groups.

Each of the enable signal providing units may be configured as a shifter SFT.

That is, the shifters SFT correspond to the respective groups of the plurality of channel circuits CH1 to CH6, and are configured to sequentially transfer the enable data EN and the shift clock SC and provide one or more enable signals to the corresponding groups.

Each of the shifters SFT generates one or more enable signals of which the enable time points are sequentially delayed in synchronization with the shift clock SC, while the enable data EN is enabled. For this operation, each of the shifters SFT may include one or more delay unit blocks, delay the enable data EN through the delay unit blocks, and output the enable signal in synchronization with a rising edge or falling edge of the shift clock SC.

In the embodiment of FIG. 6, the channel circuits CH1 to CH6 are defined as the respective groups.

Therefore, the shifters SFT are configured to provide the enable signals EN21 to EN26 to the respective channel circuits CH1 to CH6. The enable signals EN21 to EN26 have different enable time points which are sequentially delayed by the corresponding shifters SFT.

Through the above-described configuration, the enable data EN and the shift clock SC are sequentially transferred through the shifters SFT.

The shifters SFT provide the respective channel circuits CH1 to CH6 with the enable signals EN21 to EN26 having enable time points which are sequentially delayed in synchronization with the shift clock according to the transfer order of the enable data ED and the shift clock SC.

As a result, the channel circuits CH1 to CH6 sequentially output the source signals at different time points according to the enable signals EN21 to EN26 having different enable time points.

The shifter SFT may be configured to provide enable signals having the same enable time point or different enable time points to the digital-analog converter DAC, the output buffer AMP and the multiplexer MUX. In FIG. 6, enable signals outputted from the shifter SFT are represented by one symbol, for convenience of description. In reality, however, three enable signals may be outputted.

When the enable signals having different enable time points are provided to the digital-analog converter DAC, the output buffer AMP and the multiplexer MUX, respectively, differences in enable time point among the digital-analog converter DAC, the output buffer AMP and the multiplexer MUX may be decided by the delay time of the delay unit block within the shifter SFT. For example, the digital-analog converter DAC may receive the enable signal having the earliest enable time point, and the multiplexer MUX may receive the enable signal having the latest enable time point.

The source signal driving apparatus in accordance with the embodiment of FIG. 6 may also perform the operation in which the plurality of channel circuits CH1 to CH6 output the source signals at different enable time points during a channel-on operation after turn-on of the driver, included in the power-on sequence of the display device, and a channel-off operation before turn-off of the driver, included in the power-off sequence of the display device, as described with reference to FIG. 2.

Figure 7:
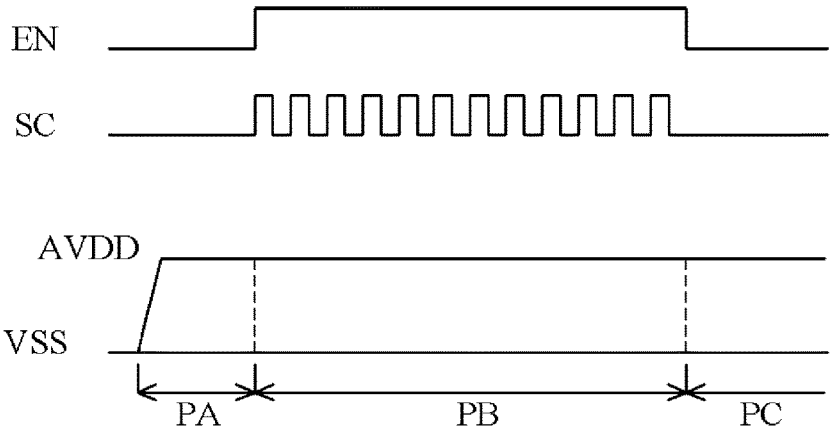
FIG. 7 is a waveform diagram for describing an operation of the source signal driving apparatus in accordance with the embodiment of FIG. 6 in response to a power-on sequence.
Figure 8:
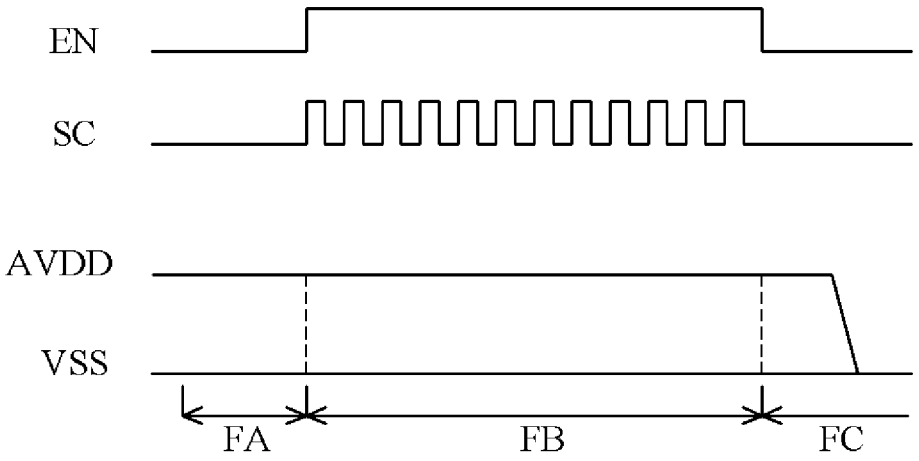
FIG. 8 is a waveform diagram for describing an operation of the source signal driving apparatus in accordance with the embodiment of FIG. 6 in response to a power-off sequence.

The operation in accordance with the embodiment of FIG. 6 may be understood with reference to FIGS. 7 and 8.

FIGS. 7 and 8 illustrate enable data EN which is enabled during an enable period for outputting source signals and a shift clock SC which has a plurality of cycles during the enable period.

Since the operation by the enable data EN and the shift clock SC has the same effect as that of FIGS. 2 to 4, the duplicated descriptions will be omitted herein.

Figure 9:
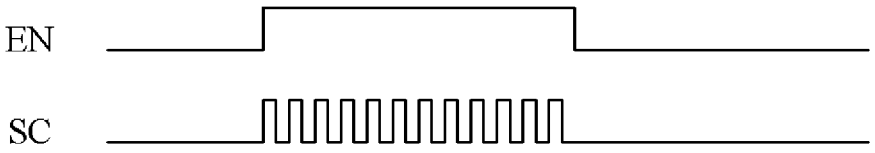
FIGS. 9 to 11 are waveform diagrams for describing a method for adjusting enable time points of enable signals by adjusting the frequency of a shift clock.
Figure 10:
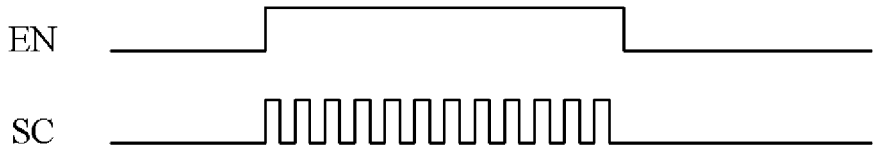
Figure 11:
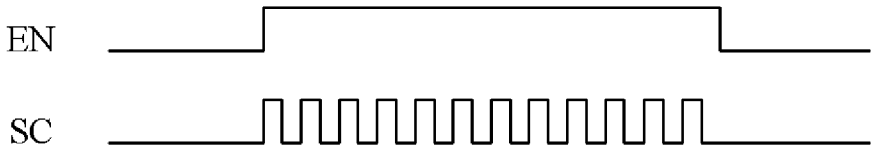

In the embodiment of FIG. 6, the enable period and the enable time points of the source signals may be varied as illustrated in FIGS. 9 to 11.

For this operation, the controller 30 may adjust the frequency of the shift clock SC such that the enable time points of the enable signals are narrowly distributed as illustrated in FIG. 9 or widely distributed as illustrated in FIG. 11. When the frequency of the shift clock SC is raised, the enable period of the enable data EN may be decreased in response to the raised frequency, and when the frequency of the shift clock SC is lowered, the enable period of the enable data EN may be increased in response to the lowered frequency.

In accordance with the above-described embodiments, the source driver, that is, the source signal driving apparatus may have the increased integration density and the increased number of channels. Thus, when an in-rush current is highly likely to occur, the source signal driving apparatus can distribute the outputs of the source signals, which makes it possible to expect an effect of suppressing an in-rush current.

In particular, the present embodiments can be applied to the channel-on or off operation of the source driver in connection with the power-on sequence or power-off sequence of the display device, thereby suppressing an occurrence of in-rush current.

As a result, the source signal driving apparatus can reduce an occurrence of in-rush current, reduce malfunctions which may occur due to an in-rush current, and prevent various migrations. Therefore, the source signal driving apparatus can simplify the manufacturing process while securing the price competitiveness of the display device, and provide convenience in design while lowering a failure rate.

While various embodiments have been described above, it will be understood to those skilled in the art that the embodiments described are by way of example only. Accordingly, the disclosure described herein should not be limited based on the described embodiments.

What is claimed is:

1. A source signal driving apparatus for a display device, comprising:

a plurality of channel circuits formed in one source driver implemented as a chip, the plurality of channel circuit connected to a power source, divided into a plurality of groups, and each configured to output sequential source signals and each comprise a digital-analog converter, an output buffer and a multiplexer;

a controller configured to provide one or more enable signals; and a plurality of transfer buffer circuitry each configured to transfer the one or more enable signals between a pair of groups, delay enable time points of the one or more enable signals by a preset time, and transfer the one or more enable signals, wherein the one or more enable signals are sequentially transferred to the plurality of groups while the enable time points are gradually delayed by the plurality of transfer buffer circuitry, and the plurality of channel circuits sequentially output the source signals at different enable time points by the one or more enable signals for the respective groups.

2. The source signal driving apparatus of claim 1, wherein each of the channel circuits comprises a digital-analog converter, an output buffer and a multiplexer which use the same power source, and the enable signal is provided to one or more of the digital-analog converter, the output buffer and the multiplexer.

3. The source signal driving apparatus of claim 1, wherein the operation in which the plurality of channel circuits output the source signals at the different enable time points by the one or more enable signals is included in initialization of a timing controller and a channel-on operation after turn-on of the source driver, the initialization of a timing controller being included in a power-on sequence based on turn-on of power for the display device.

4. The source signal driving apparatus of claim 1, wherein the operation in which the plurality of channel circuits output the source signals at the different enable time points by the one or more enable signals is included in one or more of initialization of the timing controller and a channel-off operation before turn-off of the source driver, the initialization of a timing controller being included in a power-off sequence based on turn-off of power for the display device.

5. A source signal driving apparatus for a display device, comprising:

a plurality of channel circuits formed in one source driver implemented as a chip, the plurality of channel circuit connected to a power source, divided into a plurality of groups, and each configured to output sequential source signals and each comprise a digital-analog converter, an output buffer and a multiplexer and first to third enable signals having a same enable time point are provided to the digital-analog converter, the output buffer and the multiplexer; and a controller configured to provide the groups with an equal number of one or more enable signals having different enable time points for the respective groups, wherein the plurality of channel circuits sequentially output the source signals at different enable time points by the one or more enable signals for the respective groups.

6. The source signal driving apparatus of claim 5, wherein each of the channel circuits comprises a digital-analog converter, an output buffer and a multiplexer, which use the same power source and perform a sequential process of generating the source signals in response to digital data, wherein the digital-analog converter receives the first enable signal, the output buffer receives the second enable signal, and the multiplexer receives the third enable signal, wherein among the first to third enable signals, a first enable time point of the first enable signal is the earliest, and a third enable time point of the third enable signal is the latest.

7. The source signal driving apparatus of claim 5, wherein the operation in which the plurality of channel circuits output the source signals at the different enable time points by the one or more enable signals is included in initialization of a timing controller and a channel-on operation after turn-on of the source driver, the initialization of a timing controller being included in a power-on sequence based on turn-on of power for the display device.

8. The source signal driving apparatus of claim 5, wherein the operation in which the plurality of channel circuits output the source signals at the different enable time points by the one or more enable signals is included in one or more of initialization of the timing controller and a channel-off operation before turn-off of the driver, the initialization of the timing controller being included in a power-off sequence based on turn-off of power for the display device.

9. The source signal driving apparatus of claim 5, wherein the controller generates the one or more enable signals based on the cycle of an internal clock, such that the one or more enable signals have different enable time points for the respective groups.

10. A source signal driving apparatus for a display, comprising:

a plurality of channel circuits formed in one source driver implemented as a chip, the plurality of channel circuit connected to a power source, divided into a plurality of groups, and each configured to output sequential source signals and each comprise a digital-analog converter, an output buffer and a multiplexer and first to third enable signals having the same enable time point are provided to the digital-analog converter, the output buffer and the multiplexer;

a controller configured to provide enable data which is enabled during an enable period for outputting the source signals and a shift clock which has a plurality of cycles during the enable period; and a plurality of shifter circuitry corresponding to the respective groups, and each configured to provide one or more enable signals to the corresponding group, wherein the enable data and the shift clock are sequentially transferred to the enable signal providing units, the plurality of shifter circuitry generate the one or more enable signals having enable time points which are sequentially delayed in synchronization with the shift clock according to the transfer order of the enable data and the shift clock, and the plurality of channel circuits sequentially output the source signals in response to different enable time points by the one or more enable signals for the respective groups.

11. The source signal driving apparatus of claim 10, wherein each of the channel circuits comprises a digital-analog converter, an output buffer and a multiplexer, which use the same power source and perform a sequential process of generating the source signals in response to digital data, wherein the digital-analog converter receives the first enable signal, the output buffer receives the second enable signal, and the multiplexer receives the third enable signal, wherein among the first to third enable signals, a first enable time point of the first enable signal is the earliest, and a third enable time point of the third enable signal is the latest.

12. The source signal driving apparatus of claim 11, wherein each of the plurality of shifter circuitry provides the first to third enable signals having different enable time points based on the cycle of the shift clock.

13. The source signal driving apparatus of claim 10, wherein the operation in which the plurality of channel circuits output the source signals at the different enable time points by the one or more enable signals is included in initialization of a timing controller and a channel-on operation after turn-on of the source driver, the initialization of a timing controller being included in a power-on sequence based on turn-on of power for the display device.

14. The source signal driving apparatus of claim 10, wherein the operation in which the plurality of channel circuits output the source signals at the different enable time points by the one or more enable signals is included in one or more of initialization of the timing controller and a channel-off operation before turn-off of the source driver, the initialization of a timing controller being included in a power-off sequence based on turn-off of power for the display device.

15. The source signal driving apparatus of claim 10, wherein each of the plurality of shifter circuitry provides the one or more enable signals of which the enable time points are sequentially delayed, based on the cycle of the shift clock.

16. The source signal driving apparatus of claim 10, wherein the controller adjusts the amount of in-rush current by the plurality of channel circuits, by adjusting the frequency of the shift clock in order to adjust the enable time points of the one or more enable signals for the respective groups.

* * * * *